US005645125A

United States Patent [19]

Kroetsch et al.

[11] Patent Number: 5,645,125

[45] Date of Patent: Jul. 8, 1997

[54] VEHICLE RADIATOR FOR USE WITH OR WITHOUT OIL COOLER

[75] Inventors: Karl Paul Kroetsch, Williamsville; Don Clair Corser, Lockport, both of N.Y.

[73] Assignee: General Motors Corporation, Detroit, Mich.

[21] Appl. No.: 719,497

[22] Filed: Sep. 25, 1996

[51] Int. Cl.[6] ..... F28F 9/02

[52] U.S. Cl. ..... 165/137; 165/173; 165/916

[58] Field of Search ..... 165/76, 137, 173, 165/916

[56] References Cited

U.S. PATENT DOCUMENTS

| | | | |
|---|---|---|---|
| 2,887,097 | 5/1959 | Huffman, Sr. et al. | 165/137 X |
| 4,730,668 | 3/1988 | LeMaster | 165/137 |
| 4,903,760 | 2/1990 | Joshi et al. | 165/41 |
| 4,945,951 | 8/1990 | Beamer | 138/89 |
| 5,067,561 | 11/1991 | Joshi et al. | 165/140 |
| 5,113,930 | 5/1992 | Le Gauyer | 165/78 |
| 5,499,674 | 3/1996 | Bartz et al. | 165/76 |

FOREIGN PATENT DOCUMENTS

| | | | |
|---|---|---|---|
| 290340 | 11/1988 | European Pat. Off. | 165/916 |

*Primary Examiner*—Allen J. Flanigan
*Attorney, Agent, or Firm*—Patrick M. Griffin

[57] ABSTRACT

A vehicle radiator allows a tank oil cooler to be selectively installed or left out, with no weight penalty when it is left out. A displacement device consisting of a simple blow molded, hollow block, of equal volume to the oil cooler, is installed in place of the oil cooler when the oil cooler is not installed. This avoids the addition of an extra volume of coolant, and the attendant weight penalty.

3 Claims, 2 Drawing Sheets

VEHICLE RADIATOR FOR USE WITH OR WITHOUT OIL COOLER

TECHNICAL FIELD

This invention relates to vehicle radiators in general, and specifically to a radiator adapted to be used with or without an oil cooler, and which saves significant coolant volume and weight when used without the oil cooler.

BACKGROUND OF THE INVENTION

Vehicle radiators of the parallel flow type comprise a metal core, consisting of brazed flow tubes and cooling fins, flanked by a pair of manifold tanks that feed coolant into and out of the core. The outlet tank, which receives the coolant after it has been cooled in the core, has a lower temperature than the inlet tank, and is the logical candidate for the inclusion of independent, auxiliary heat exchangers used to cool transmission fluid or lubricant oil. These are generally referred to just as oil coolers. Oil runs through the oil cooler, sealed off from the radiator coolant, but bathed in and cooled by it. The manifold tanks, increasingly, are molded plastic units, and can be made with a volume adequate to enclose the additional oil cooler without a great increase in weight, beyond the inevitable weight of the oil cooler itself. The plastic manifold tank is typically molded with a pair of through holes in one side wall to accommodate the inlet and outlet of the oil cooler. A good example of this type of radiator and cooler may be seen in co assigned U.S. Pat. No. 5,067,561 issued Nov. 26, 1991 to Joshi et al., and is described in further detail below.

Another trend in automotive design is the accommodation of as many build variations as possible with only a few standard or modular components. Vehicles in one model line will likely be built with or without an oil cooler, depending on the engine and transmission package selected. The radiator should be capable of selectively incorporating the oil cooler, or not, as needed, with as little change as possible. If the oil cooler is not to be installed, then the radiator outlet tank mold is modified to seal off the through holes and make the tank wall integral at that point, or they are otherwise plugged. The radiator operates just as before. However, there is an inevitable increase in the volume (and weight) of coolant in the outlet tank, as coolant now fills the void left by the missing oil cooler. This can add nearly as much weight as the oil cooler itself, and vehicle weight reduction is a continual concern.

SUMMARY OF THE INVENTION

The invention provides a radiator usable with or without an oil cooler that does not add extra coolant or its attendant weight when the oil cooler is not installed.

In the preferred embodiment disclosed, a conventional radiator core and manifold tank are used. In addition, a coolant displacing structure is used. As disclosed, this is a hollow, blow molded block which is installed in place of the oil cooler when the oil cooler is eliminated. The molded block is similar in size and volume to the oil cooler, although much lighter. In the embodiment disclosed, the block is also designed to be mounted to and through the tank through holes, thereby sealing and blocking them. When the radiator and tanks are filled, the block displaces an equal volume of coolant, saving very significant weight. The volume of coolant left is sufficient for engine cooling purposes, since it is basically the same volume as would have existed had the oil cooler been installed.

BRIEF DESCRIPTION OF THE DRAWINGS

These and other features of the invention will appear from the following written description and from the drawings, in which.

DESCRIPTION OF THE PREFERRED EMBODIMENT

Figure 1:
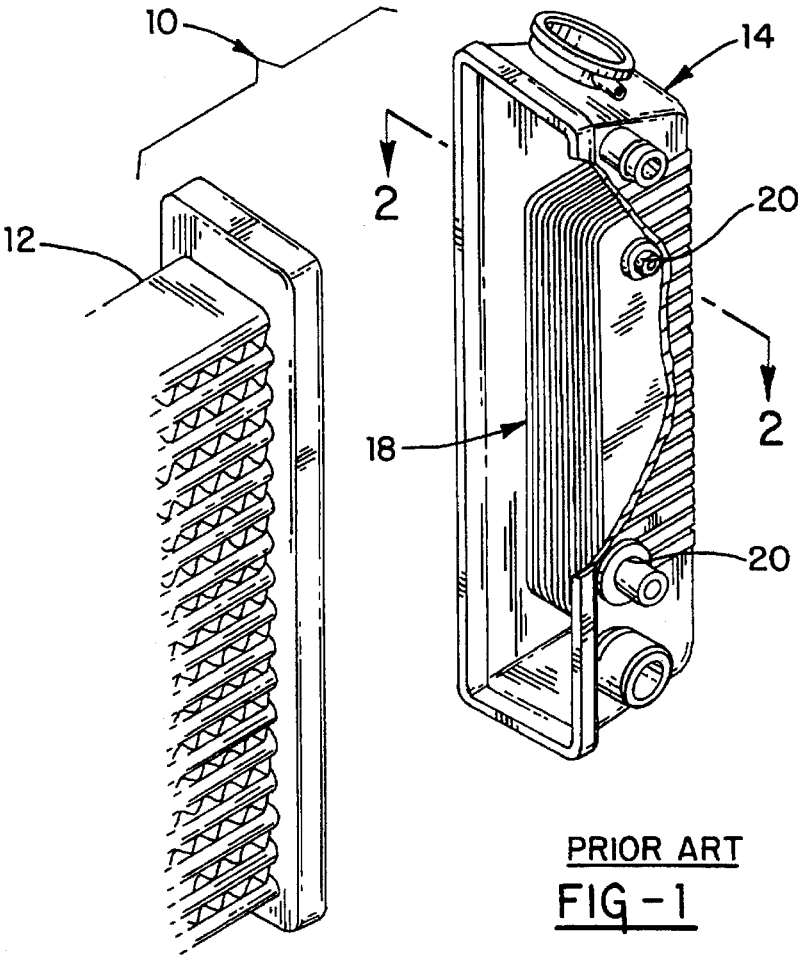
PRIOR ART FIG-1
FIG. 1 is a perspective view of a prior art radiator and installed oil cooler.
Figure 2:
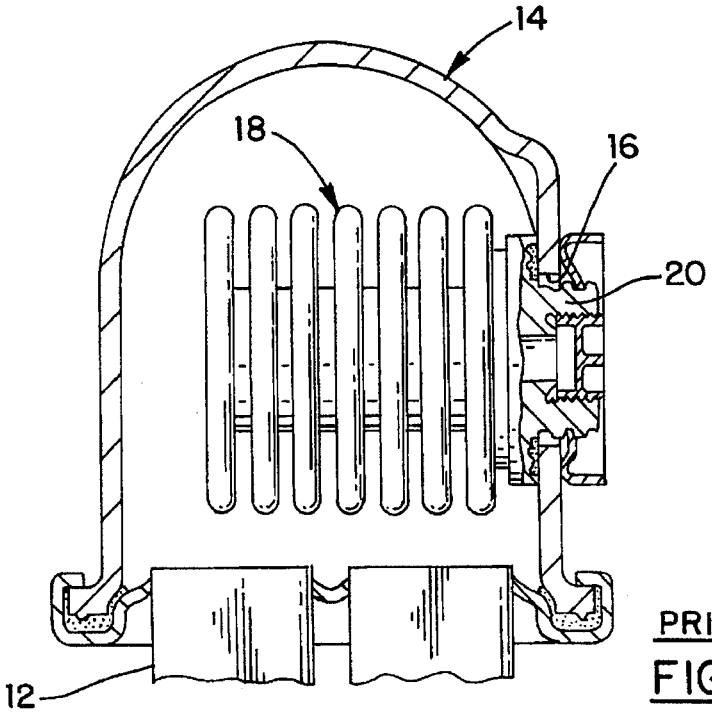
PRIOR ART FIG-2
FIG. 2 is a cross section of FIG. 1 taken in the plane represented by the line 2—2 of FIG. 1.

Referring first to FIGS. 1 and 2, a conventional radiator 10 includes a brazed metal core 12 and molded plastic tank, indicted generally at 14. Tank 14 is an open sided box molded of glass reinforced nylon, one of which is sealed to each side of core 12 to provide inlet and outlet tanks. Only one tank 14 is illustrated, which is the outlet tank that receives coolant from core 12 after it has been cooled by forced air blown over core 12. Being integrally molded, tank 14 can incorporate many surface and structural features into one integral piece, including filler necks, drain spouts, reinforcing ribs, mounting brackets and so on. Among these integral features are a pair of simple round through holes, one of which is best seen in FIG. 2 at 16. The through holes 16 would be created by a cylindrical feature in the mold, either a removable insert or an integral element, depending on whether it was necessary to selectively mold tank 14 without the holes 16. The holes 16 serve as mounts and as exterior inlet and outlet openings for a metal oil cooler, indicated generally at 18. Oil coolers 18 of the general type shown are disclosed in several co assigned patents, such as U.S. Pat. No. 5,067,561. They consist of a brazed stack of metal plates and fins, and can take up a significant portion of the volume of the outlet tank 14. As best seen in FIG. 2, oil cooler 18 has cylindrical fittings 20 that are mounted through the through holes 16, to which oil lines, not illustrated, would be later connected. However, not all vehicles using a particular radiator will need an oil cooler. When oil cooler 18 is not needed, tank 14 can be molded without the inserts to eliminate the through holes 16. When the engine cooling system and radiator 10 are filled, there will inevitably be an extra volume of coolant in tank 14, filling up the empty space left by the absent cooler 18. This will not impair the effectiveness of the cooling system, which does not suffer from an excess of coolant. There will be an attendant weight penalty of up to a pound, however, which is very significant in an arena where weight savings of mere ounces are fought for.

Figure 3:
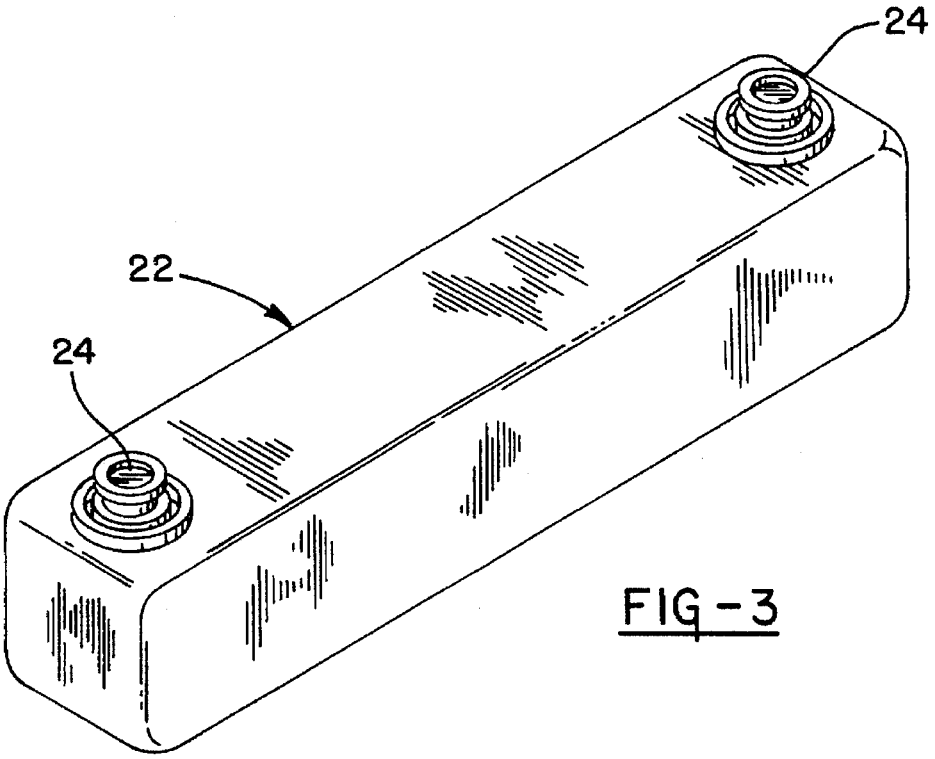
FIG. 3 is a perspective view of the displacing block of the invention alone.
Figure 4:
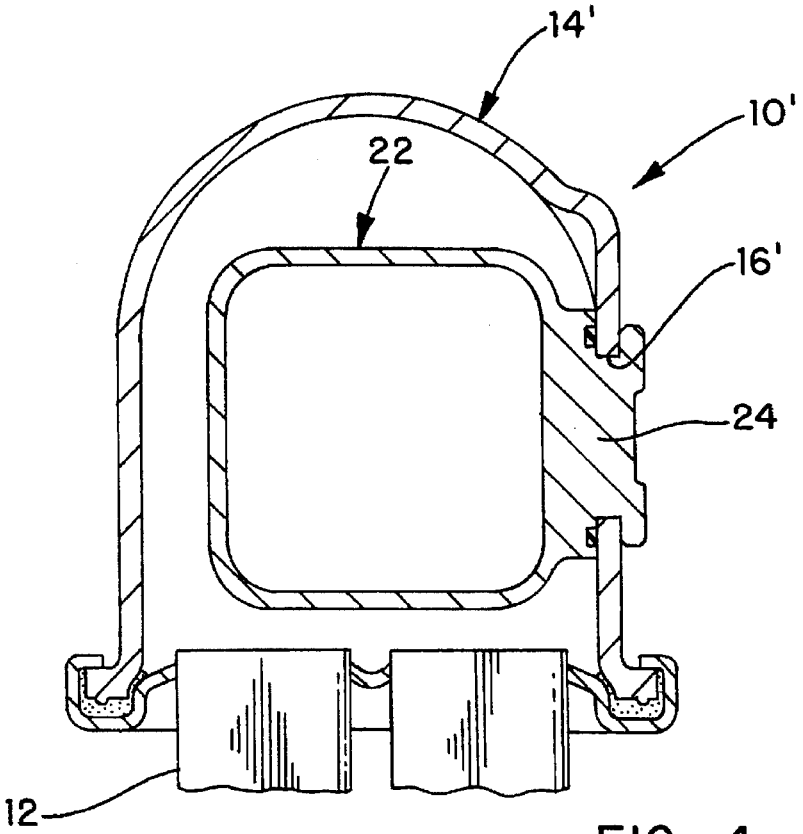
FIG. 4 is a view like FIG. 2, showing the displacing block installed.

Referring next to FIGS. 3 and 4, the invention is incorporated in an identical radiator, like components of which are given the same number as above with a prime (′). The invention eliminates almost all of the indicated weight penalty by excluding the excess coolant when the system is filled. This is done with a single extra component, a coolant displacing block, indicated generally at 22. Block 22 is a hollow, blow molded plastic unit, which has a volume basically equal to oil cooler 18, but which is obviously far lighter. Block 22 has a simple box shape, but for two integral plugs 24. The plugs are sized and located so as to pop through the tank through holes 16′, as shown in FIG. 4. This securely mounts block 22 within the interior of tank 14′, in the same location where oil cooler 18 would have been. The plugs 24 can be glued, heat staked, or sonically welded so as to provide a fluid tight seal, eliminating the need to mold tank 14' without the through holes 16'. When the cooling system is filled, a volume of coolant equal to the volume of block 22 is eliminated. This still leaves sufficient coolant for the system to operate, since only about the same volume of coolant is displaced as the oil cooler 18 would have displaced itself. However, the weight saving is very significant. While the block 22 is an extra component, it is very light weight, and can be made with very little cost. There would also be some time, cost and inventory savings inherent in not having to mold tank 14' without the through holes 16'.

If desired, a different block construction could be used, such as a block of foam of equivalent volume. So long as it is substantially hollow and impervious to coolant (foam with an impervious outer skin would serve), of comparable volume to the oil cooler 18, and anchored within the tank 14 against jostling or free floating, it should work well. If desired, a tank like 14 could have an internal snap fit feature added to its interior, to which a block could be attached instead of using the plugs 24. With an alternative construction of this type, the tank would have to be molded so as to eliminate the through holes 16, or they would be otherwise sealed fluid tight. Therefore, it will be understood that it is not intended to limit the invention to just the embodiment disclosed.

We claim:

1. A vehicle radiator assembly adapted for use with or without an in tank oil cooler, comprising, a radiator core, at least one hollow manifold tank sealed to said core and adapted to have an oil cooler selectively mounted within said tank, and, a substantially hollow, impervious coolant displacer adapted to be mounted within said tank in place of said oil cooler and having a comparable volume to said oil cooler, whereby, when said radiator assembly is used without said oil cooler, a volume of coolant comparable thereto is displaced from said tank, thereby reducing the weight of said radiator assembly accordingly.

2. A vehicle radiator assembly adapted for use with or without an in tank oil cooler, comprising, a radiator core, at least one hollow manifold tank sealed to said core and adapted to have an oil cooler selectively mounted within said tank, and, a substantially hollow, blow molded block adapted to be mounted within said tank in place of said oil cooler and having a comparable volume to said oil cooler, whereby, when said radiator assembly is used without said oil cooler, a volume of coolant comparable thereto is displaced from said tank by said block, thereby reducing the weight of said radiator assembly accordingly.

3. A vehicle radiator assembly adapted for use with or without an in tank oil cooler, comprising, a radiator core, at least one hollow manifold tank sealed to said core and having a pair of through holes through which fittings of said an oil cooler can be fitted to selectively mount said oil cooler within said tank, and, a substantially hollow, blow molded block having a pair of integral plugs adapted to be sealingly fitted through said tank through holes so as to mount said block within said tank in place of said oil cooler, said block having a comparable volume to said oil cooler, whereby, when said radiator assembly is used without said oil cooler, a volume of coolant comparable thereto is displaced from said tank by said block, thereby reducing the weight of said radiator assembly accordingly.

* * * * *